United States Patent [19]

Kanda

[11] 4,321,696

[45] Mar. 23, 1982

[54] ULTRASONIC TRANSDUCER USING ULTRA HIGH FREQUENCY

[75] Inventor: Hiroshi Kanda, Tokorozawa, Japan

[73] Assignee: Hitachi, Ltd., Tokyo, Japan

[21] Appl. No.: 120,884

[22] Filed: Feb. 12, 1980

[51] Int. Cl.[3] ..... H04R 17/00

[52] U.S. Cl. ..... 367/157; 310/335

[58] Field of Search ..... 367/140, 162, 157, 159; 310/335

[56] References Cited

U.S. PATENT DOCUMENTS 2,863,075 12/1958 Fry ..... 310/335

3,958,559 5/1976 Glenn et al. ..... 310/335

3,995,179 11/1976 Flournoy et al. ..... 367/162

*Primary Examiner*—Theodore M. Blum

*Attorney, Agent, or Firm*—Craig and Antonelli

[57] ABSTRACT

An ultrasonic transducer comprises an acoustic wave propagation medium, a piezoelectric element mounted on one surface of the propagation medium, and an ultrasonic lens formed in the opposite surface of the propagation medium and having a predetermined focal distance. The ultrasonic radiation generated from the piezoelectric element is propagated through the propagation medium and focused by the lens. The axial length of the propagation medium is selected to be 1/N (N: odd number) of a Fresnel focal distance.

5 Claims, 5 Drawing Figures

ULTRASONIC TRANSDUCER USING ULTRA HIGH FREQUENCY

BACKGROUND OF THE INVENTION

The present invention relates to ultrasonic transducers for use with devices using high frequency acoustic radiation and more particularly to such transducers which are suitable for use in acoustic microscopes.

Recent advances in the generation and detection of high frequency acoustic waves extending up to 1 GHz have made possible an acoustic wave length of about 1 micron under water, giving rise to the availability of an acoustic microscope.

More particularly, an acoustic wave beam of an extremely small size is produced which is projected on a target specimen and the propagation loss of acoustic radiation due to reflection, scattering and penetrant attenuation at the target is detected to obtain information representative of the elastic properties of the target. In order to apply this principle to an acoustic microscope, a surface of the specimen is scanned two-dimensionally with the focused acoustic wave beam and the perturbed energy is displayed on a cathode-ray tube in synchronism with the scanning.

In such an apparatus, the resolution which is a fundamental characteristic of this type of apparatus depends on the extent to which the size of the acoustic wave beam is reduced. A prior art ultrasonic transducer, as shown in FIG. 1, directed to such a reduction in beam size has a cylindrical crystalline body 20 as an ultrasonic wave propagation medium of sapphire, for example, with one flat surface optically polished and an opposite surface formed with a concaved recess 25. An RF electric signal produced from an electric signal source 10 is applied to a piezoelectric film 15 which in turn transmits an RF acoustic wave in the form of a plane wave into the crystalline body 20. The acoustic plane wave is focused at a given focal point F by means of a positive acoustical lens 40 formed at an interface between the arcuate recess 25 and an ultrasonic wave focusing medium 30, typically water. As well known in the art, a sufficiently small ratio between focal length and aperture size, that is, a sufficiently small F-number of the lens can contribute to generation of the ultrasonic wave beam of a small size which approximates its wave length. When irradiating this beam onto a target, perturbed ultrasonic energy is produced from the target. For reception of the perturbed energy, it is possible to employ either a reflection mode using the same crystalline body and piezoelectric film shown in FIG. 1 or a transmission mode using a crystalline body and a piezoelectric element, similar to those of FIG. 1, which are positioned confocally.

Let R, $C_1$ and $C_2$ denote a radius of curvature of the concaved ultrasonic lens 40, the speed of sound in the lens material and the speed of sound in the focusing medium, respectively. Then, a front-face focal length F is, $$F = \frac{R}{1 - C_1/C_2} \quad (1)$$

and a back-face focal length F' is, $$F' = R(C_1/C_2) \quad (2)$$

The lens effect can be determined by multiplying a sound pressure distribution on the back-face focal plane by a pupil function of the lens and subjecting the product to a two-dimensional Hankel transformation. According to a lens theory in optics, for the sake of obtaining good focussing effect, it is required that the sound pressure distribution lie on the back-face focal plane and that the sound pressure distribution on the back-face focal plane be of a uniform amplitude and phase of a plane wave or subject to a Gaussian distribution in respect of amplitude and phase of a plane wave. Another amplitude distribution may also attain the focussing effect but it requires a great number of multi-lens systems for elimination of the lens aberration and is impractical for industrial purposes.

When the piezoelectric film shown in FIG. 1 is driven, the sound pressure distribution occurs on the back-face focal plane inside the lens and assumes a sophisticated pattern under the influence of the interference of acoustic wave. Therefore, it is of a great significance in lens design to select aperture size (diameter) $2\rho_o$ of the piezoelectric film, distance l between the film and the back-face focal plane of the lens, and aperture size $2a$ of the lens.

Various sound pressure distributions of the acoustic wave transmitted from the piezoelectric film to the interior of the lens are graphically shown in FIG. 2 by using the above values. In the figure, a curve on the left of the ordinate axis represents a sound pressure distribution along the lens axis and curves on the right represent orientational distributions at distances in terms of normalized l by $\rho_o^2/\lambda$, $\lambda$ being the wavelength of acoustic wave used. It will be appreciated that within a distance of 1 (one) or $\rho_o^2/\lambda$ from the piezoelectric film covering a so-called near field, sophisticated patterns occur which are due to the interference of the acoustic wave whereas outside the distance of 1 or in a so-called far field, a Gaussian-like (strictly, Airy function) distribution occurs. Here, $\rho_o^2/\lambda$ is usually called a Fresnel focal distance.

Therefore, in a first prior art lens design, $\rho_o$, l and a are so designed as to yield the far field sound pressure distribution on the back-face focal plane of the lens by determining $l=\rho_o^2/\lambda$ and $a \approx \rho_o$. Thus, as will be seen from FIG. 2, the acoustic wave obviously assumes the Gaussian-like sound pressure distribution on the back-face focal plane. More specifically, as shown in FIG. 3, the acoustic wave which is expected to assume the sound pressure distribution at point $A_o$ (corresponding to point B in FIG. 2) which is distant from the piezoelectric film by $\rho_o^2/\lambda$ is irradiated onto the lens having an aperture of $2a$ $(=2\rho_o)$.

Pursuant to a second lens design, the distance between the back-face focal plane of the lens and the piezoelectric film is reduced to an extent that no interference of ultrasonic wave occurs. While this second design has many applications in the range of MHz frequencies, it is almost impractical in the range of GHz frequencies. Because with sapphire as a lens material, the ultrasonic wave at 1 GHz has a wavelength of about 11 $\mu$m and there needs preparation of an extremely thin lens. Therefore, the first prior art lens design alone is practical.

The arrangement according to the first prior art lens design, however, is disadvantageous as will be described below.

In the first place, as the frequency increases, the Fresnel focal distance $\rho_o^2/\lambda$ increases accordingly, a disadvantage thereby being that ultrasonic attenuation in the crystalline body forming the lens is aggravated and the cost for material is increased. For $\rho_o$ being 1 mm, for example, $\rho_o^2/\lambda$ for sapphire is drastically prolonged, amounting to about 91 mm with an accompanied attenuation of 5 dB. For a fused silica lens, $\rho_o^2/\lambda$ is 166 mm and the attenuation is 54 dB.

In the second place, when the acoustic wave is necessarily increased in frequency to increase the resolution of the acoustic microscope, it suffers from a large attenuation within the focusing medium (typically water) in which it is focused. Accordingly, in order to obtain a high resolution, a lens is needed having a small aperture. Reduction in lens aperture corresponds to reduction in $\rho_o^2/\lambda$ so that in compliance with the reduced lens aperture, it is necessary to prepare a piezoelectric film of a reduced diameter of the same size. For 1 GHz, for example, the desirable lens aperture is 100 μm but a piezoelectric film of the corresponding 100 μm aperture is difficult to prepare and to handle and in addition, has a high impedance level for which the impedance matching is difficult at RF electric signal supplied.

As described above, the prior art has many difficulties for production of an ultrasonic transducer since it requires an extensively elongated crystalline body and a piezoelectric film of a reduced diameter of the same size as the reduced lens aperture.

SUMMARY OF THE INVENTION

An object of the present invention is to provide an ultrasonic transducer using ultra high frequency wherein attenuation of the acoustic wave can be minimized.

Another object of the invention is to provide an ultrasonic transducer which can yield a high resolution even with a piezoelectric element of a larger aperture than that of a lens.

To attain the above objects, the present invention is featured by an acoustic wave propagation medium having an axial length which is 1/N (N: odd number greater than one) of a Fresnel focal distance.

Specifically, the present invention analyzed the sound pressure distribution to find, within the Fresnel focal point, axial points at which Gaussian-like distributions of sound pressure take place and which correspond to 1/N (N: odd number greater than one) of the Fresnel focal distance, and the present invention is based on this analytical result.

DESCRIPTION OF THE PREFERRED EMBODIMENT

The present invention has made a mathematical approach to sound pressure distributions in the near field which are normally difficult to analyze to find that Gaussian-like sound pressure distributions pursuant to an optical lens theory take place within the Fresnel focal distance. It was then proven that a lens subject to such a sound pressure distribution which occurs at a back-face focal plane of the lens can yield a good focusing characteristic.

Figure 1:
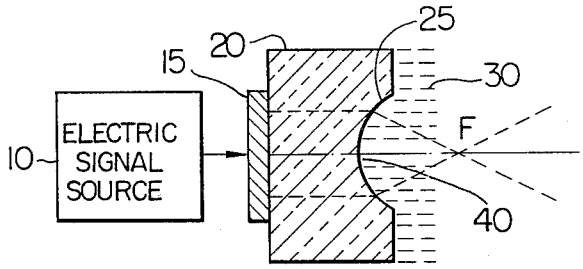
FIG. 1 PRIOR ART
FIG. 1 is a schematic view to show construction and operation of a prior art ultrasonic transducer.
Figure 2:
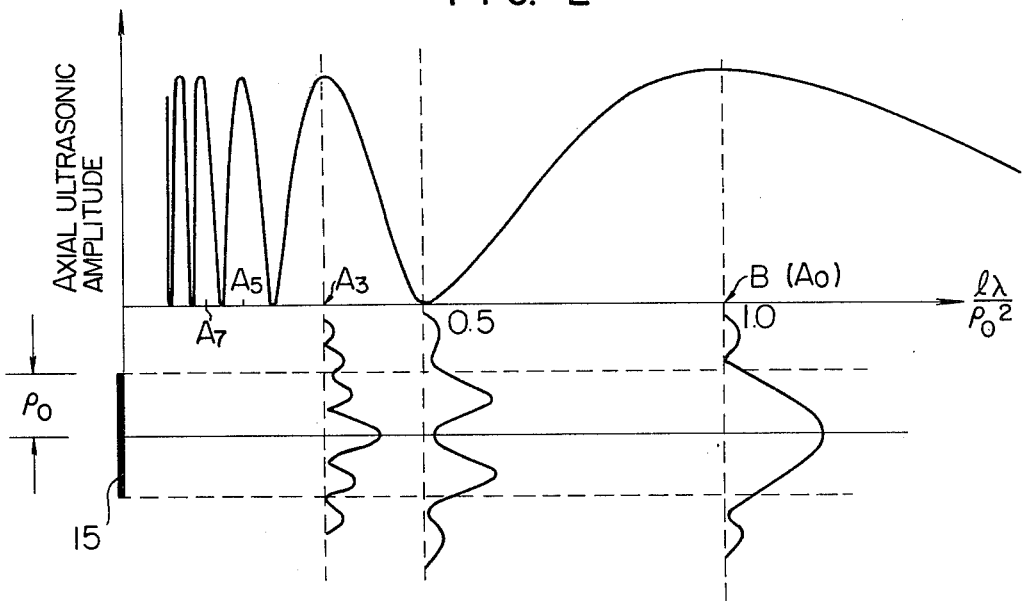
FIG. 2 is a graphical representation to show sound pressure distributions of the acoustic wave beam.
Figure 3:
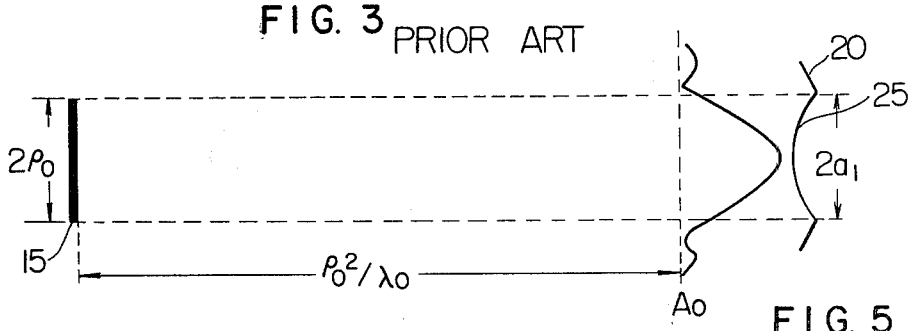
FIG. 3 PRIOR ART
FIG. 3 is a diagrammatic representation to show a sound pressure distribution as applied to the prior art transducer.

To detail with reference to FIG. 2, as far as the major beam is concerned, a Gaussian-like sound pressure distribution takes place at an axial point other than $\rho_o^2/\lambda$ point, for example, at point $A_3$.

Figure 4:
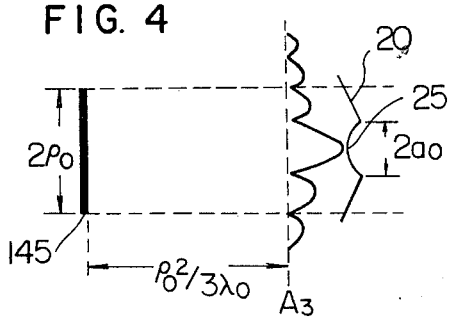
FIG. 4 is a diagrammatic representation to show a sound pressure distribution as applied to an ultrasonic transducer according to the present invention.

Thus, in accordance with this invention, as shown in FIG. 4, the acoustic wave with the sound pressure distribution taking place at point $A_3$, for example, which is distant from a piezoelectric element by $\rho_o^2/3\lambda$ is irradiated onto a lens of an aperture size of $2a_o$ ($=2\rho_o/3$). A focusing characteristic fully equivalent to that of the prior art is then obviously attributable to this sound pressure distribution incident to the inside of the lens aperture, because the acoustic wave incident to the lens aperture of $2a_1$ ($=2\rho_o$) in accordance with the prior art assumes the sound pressure distribution which takes place at point $A_o$ distant from the piezoelectric element by $\rho_o^2/\lambda$ and which is similar to the sound pressure distribution as shown in FIG. 4.

As a result of computation, axial points like the point $A_3$ correspond to ones at which the sound pressure along the lens axis has the maximum value. More particularly, axial ultrasonic distribution I at an axial point within the crystalline body which is distant by l from the piezoelectric disk element having a radius of $\rho_o$ is given by, $$I = \sin^2\left\{\frac{\pi}{\lambda}\left(\sqrt{l^2+\rho_o^2} - l\right)\right\}. \tag{3}$$

Distance $l_n$ at which the peaks take place satisfies, $$\frac{\pi}{\lambda}\left(\sqrt{l^2+\rho_o^2} - l\right) = (n+\tfrac{1}{2})\pi \tag{4}$$

where n=0, 1, . . . , so that, $$l_n = \frac{\rho_o^2 - \left(\frac{2n+1}{2}\right)^2\lambda^2}{(2n+1)\lambda} \tag{5}$$

stands.

In the equation (5), for n=0, $l_o=\rho_o^2/\lambda$ stands to provide the Fresnel focal distance; for n=1, $$l_1 = \left(\rho_o^2 - \frac{9}{4}\lambda^2\right)/3\lambda \simeq \rho_o^2/3\lambda$$

stands to provide the point $A_3$. In the equation (5), $\rho_o >> \lambda$ holds in general so that $l_n \simeq \rho_o^2/(2n+1)\lambda$ stands. Consequently, it is concluded that axial points to meet the present invention lie at distances which are 1/(odd number greater than one) of the Fresnel focal distance. The analytical result also showed that the axial ultrasonic distribution at point $A_3$ has a width within which the Gaussian-like distribution is present, the width being expressed as $2\rho_o/3$ by using the aperture size of the piezoelectric element.

In short, the present invention is based on the aforementioned analytical result and grounded on the fact that there are axial points within the Fresnel focal distance at which the Gaussian-like distribution takes place, that these points correspond to 1/N (N: odd number greater than one) of the Fresnel focal distance, and that the width of the Gaussian-like distribution to meet the present invention is 1/N of the aperture size of the piezoelectric element.

Figure 5:
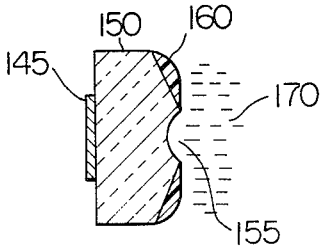
FIG. 5 is a schematic view to show an ultrasonic transducer embodying the present invention.

FIG. 5 schematically shows one embodiment of an ultrasonic transducer in accordance with teachings of the present invention. As shown, a cylindrical crystalline body 150 serving as an acoustic wave propagation medium and made of such a material as sapphire or fused silica has one surface on which a piezoelectric element 145 is mounted and the opposite surface in which a concaved lens 155 is formed. With this construction, for the aperture size of the piezoelectric element 145 being $2\rho_o$, the lens aperture size is selected to be $2\rho_o/N$ to make is possible to make use of point $A_N$ (N=3,5,7, . . .), and the axial length of the lens crystalline body 150 is determined in such a way that the distance between the piezoelectric element 145 and the backface focal plane of the lens is $\rho_o^2/\lambda N$. In this manner, it is ensured that the acoustic wave of the Gaussian-like distribution is incident to the lens interface and the fairly focused beam can be obtained. The present inventor materialized an ultrasonic transducer for use at 1 GHz by using a sapphire crystal lens, with such structural dimensions as $\rho_o$1 mm, the lens length is 13 mm and the lens aperture a is 143 $\mu$m, which dimensions correspond to N=7. If a portion of the acoustic wave other than the Gaussian-like axial ultrasonic distribution incident to the lens aperture is irradiated onto a portion of the interface other than the lens aperture and refracted thereat to be transmitted into water (ultrasonic wave focusing medium 170), the lens characteristics will be disturbed. Therefore, in accordance with this embodiment, the portion of the crystal-water interface other than the lens aperture is applied with an absorbant 160 such as a plastic material of epoxy resin or a vinyl tape, thereby preventing the sidelobe being transmitted into the medium 170. The other portion than the lens aperture is also tapered to prevent the transmission of the sidelobe into the medium 170 and to mitigate the multiple echo within the lens.

If a lens with an aperture size of 143 $\mu$m according to this embodiment were prepared in accordance with the prior art measure, a piezoelectric film with an aperture size of 143 $\mu$m would be required which is very difficult to handle practically, and this film would have an impedance level of 1 KΩ. The piezoelectric film of this embodiment, however, is easy to match with a 50Ω coaxial cable.

As has been described, the present invention can offer the piezoelectric film of the aperture size which is easy to impedance-match with the electrical system and easy to handle, and the lens aperture size which is 1/(odd number greater than one) of the piezoelectric film aperture, thereby highly mitigating difficulties in lens design of the acoustic microscope.

I claim:

1. An ultrasonic transducer for use at ultra high frequencies comprising: an acoustic wave propagation medium, a piezoelectric element mounted on one surface of the propagation medium, and an ultrasonic lens formed in the opposite surface of the propagation medium and having a predetermined focal distance, said acoustic wave propagation medium having a length in the direction of the axis of said lens which is 1/N (N: odd number greater than one) of the Fresnel focal distance of the transducer.

2. An ultrasonic transducer according to claim 1, wherein said piezoelectric element has a larger diameter size than the aperture size of said lens.

3. An ultrasonic transducer according to claim 1, wherein said lens has an aperture size which is sufficient to cause a major beam contained in a sound pressure distribution occuring at a back-face focal plane of said lens to pass through said lens aperture.

4. An ultrasonic transducer according to claim 1, wherein said lens is tapered at an interface contiguous to a predetermined ultrasonic wave focusing medium in which the acoustic wave having passed through said lens is focused.

5. An ultrasonic transducer according to claim 1, wherein said lens is applied with an absorbant at an interface contiguous to a predetermined ultrasonic wave focusing medium in which the acoustic wave having passed through said lens is focused.

* * * * *